US008696324B2

(12) United States Patent
Williams

(10) Patent No.: US 8,696,324 B2
(45) Date of Patent: Apr. 15, 2014

(54) QUINTUPLEX MUD PUMP

(75) Inventor: Jason C. Williams, Magnolia, TX (US)

(73) Assignee: Jason C. Williams, Magnolia, TX (US)

( * ) Notice: Subject to any disclaimer, the term of this patent is extended or adjusted under 35 U.S.C. 154(b) by 347 days.

(21) Appl. No.: 13/158,784

(22) Filed: Jun. 13, 2011

(65) Prior Publication Data

US 2012/0315167 A1 Dec. 13, 2012

(51) Int. Cl.
*F04B 17/03* (2006.01)

(52) U.S. Cl.
USPC ..... 417/269; 417/271; 417/522; 417/529

(58) Field of Classification Search
USPC ..... 417/269–273, 522, 529
See application file for complete search history.

(56) References Cited

U.S. PATENT DOCUMENTS

2007/0006579 A1* 1/2007 Takada et al. ..... 60/444
2007/0204609 A1* 9/2007 Sumomozawa et al. ..... 60/487
2009/0092510 A1* 4/2009 Williams et al. ..... 417/521

FOREIGN PATENT DOCUMENTS

WO PCT/US2008/078720 10/2008

* cited by examiner

*Primary Examiner* — Peter J Bertheaud
*Assistant Examiner* — Dominick L Plakkoottam
(74) *Attorney, Agent, or Firm* — Streets & Steele; Patrick K. Steele; Jeffrey L. Streets

(57) ABSTRACT

A quintuplex mud pump includes a pair of motors (18), a crankshaft (40) supporting five eccentric lobes (44), and first and second bull gears (30). Each of two pinion shafts (20) are rotationally independent, and has a pinion gear interfacing with a respective bull gear on the crankshaft (40). Five connecting rods (46) interconnect a respective eccentric lobe and a respective piston.

17 Claims, 4 Drawing Sheets

QUINTUPLEX MUD PUMP

FIELD OF THE INVENTION

The present invention relates to mud pumps for the type used during drilling operations to pump mud into a well. More particularly, the present invention relates to a quintuplex mud pump with a crankshaft powering each of five pistons.

BACKGROUND OF THE INVENTION

Tripex mud pumps are commonly used in oilfield operations to pump fluid into a well. Instantaneous flow from a tripex mud pump can vary by approximately 23%, since the pump produces a maximum flow of about 106% during some crankshaft angles, and produces a minimum flow of 83% during other crankshaft angles. These varying flow rates tend to produce undesirable pressure changes or "noise" in the pumped mud which interferes with downhole telemetry and other techniques used during measurement while drilling or logging while drilling operations.

A quadruplex pump with four pistons or plungers also has a significantly high flow rate variation up to about 33%, while the flow rate for a sextuplex with six plungers is approximately 14%. Substantially reduced pressure variations can be achieved with a quintuplex pump, such as that disclosed in PCT/US2008/078720, wherein the pressure variation from a pump is approximately 7% or less.

In spite of the advantages of the quintuplex mud pump as disclosed in PCT/US2008/078720, the pump has disadvantages which have limited its acceptance. One such problem relates to the pinion gear, which at times must be replaced or refurbished. The long length of pinion gear makes it impractical in some installations with limited space to remove the pinion gear from the pump. Another significant problem with the quintuplex mud pump discussed above is that two bull gears driven by a common pinion shaft are used to power a common crankshaft, which commonly leads to one of the bull gears carrying a larger portion of the load than the other bull gear due to gear machining tolerances, thereby leading to excessive wear and maintenance problems. As a practical matter, these prior art bull gears use only one side of the gear tooth, and the other side of the gear tooth serves no practical purpose. There is no mechanism for effectively taking out backlash, and the two bull gears, if cut out of tolerance, must be recut.

The disadvantages of the prior art are overcome by the present invention, an improved quintuplex mud pump is hereinafter disclosed.

SUMMARY OF THE INVENTION

In one embodiment, a quintuplex mud pump comprises a pair of motors, with each motor powering a respective one of a pair of pinion shafts. The pinion shafts in turn drive first and second bull gears which together drive a crankshaft with five eccentric lobes. Each pinion shaft is rotatably supported in the pump independent of the other pinion shaft. The bull gears interface between a respective pinion shaft and the crankshaft. Five connecting rods are each disposed on one of the eccentric lobes and on one of the five pistons and transfer the reciprocal movement of a connecting rod to linear movement of a corresponding piston.

These and further features and advantages of the present invention will become apparent from the following detailed description, wherein reference is made to the figures in the accompanying drawings.

DETAILED DESCRIPTION OF PREFERRED EMBODIMENTS

Figure 1:
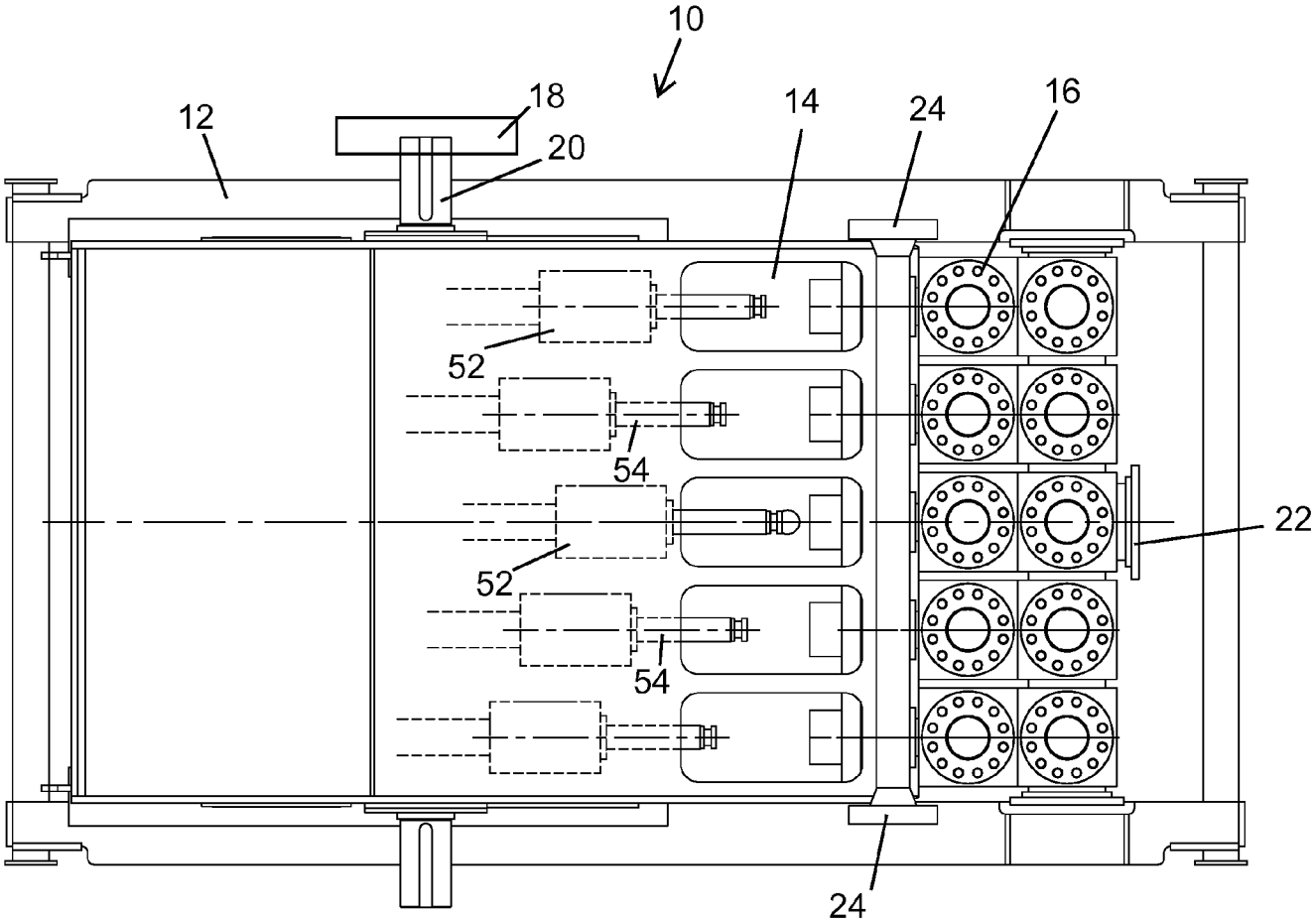
FIG. 1 is a top view of a quintuplex mud pump.
Figure 2:
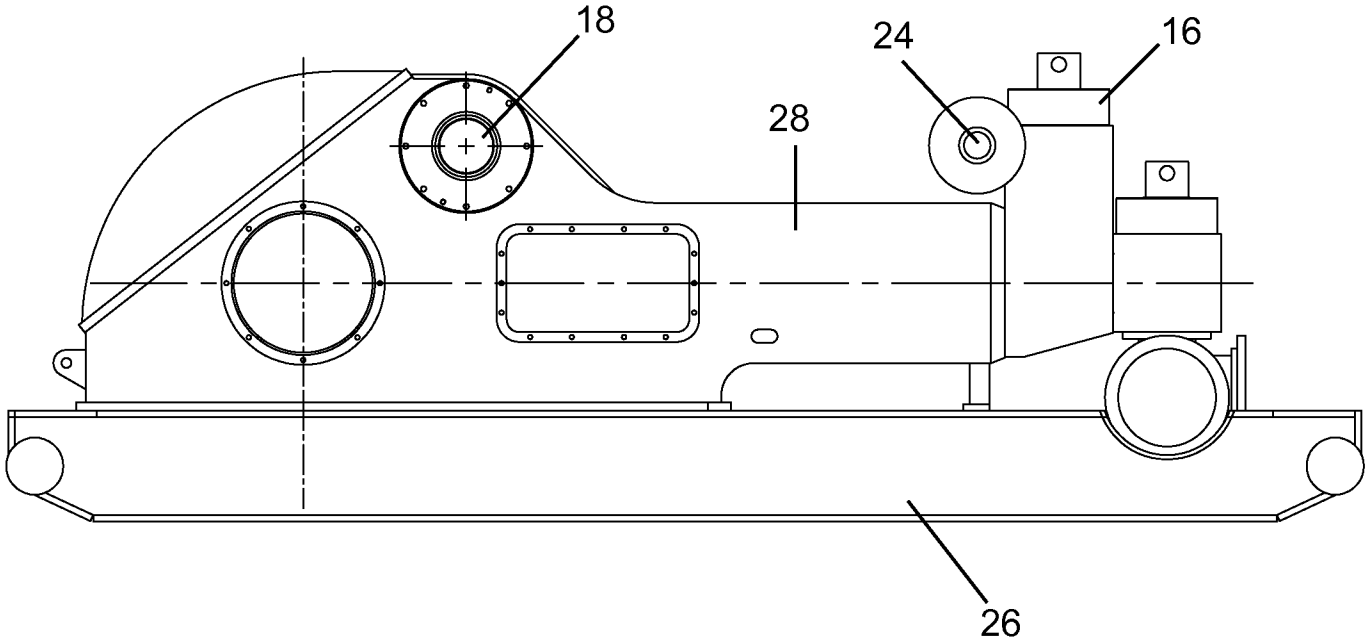
FIG. 2 is a side view of the mud pump shown in FIG. 1.

The quintuplex mud pump 10 shown in FIGS. 1 and 2 includes a power assembly 12, a crosshead assembly 14, and a fluid assembly 16. Two separate drives 18, which conventionally may each be an electric motor, may be used to drive a respective one of two pinion shafts of the power assembly, as explained below. Internal gearing within the power assembly 12 converts the rotation of the pinion shafts to rotation of the crankshaft. This gearing includes a pinion gear on each pinion shaft that couples to a respective bull gear on the crankshaft to transfer rotation of the pinion shaft to rotation of the crankshaft.

FIG. 1 illustrates a suitable location for the intake manifold 22 to the fluid assembly 16, and the pair of outlet manifolds 24 for pumping mud to a well. The entire assembly may be provided on a suitable skid 26 for ease of transportation, and a housing 28 as shown in FIG. 2 encloses internal pump components. Withdrawal of the piston or plunger during the suction stroke pulls fluid into the assembly, and is subsequently pushed out during the power stroke to force fluid under pressure into the well.

Figure 3:
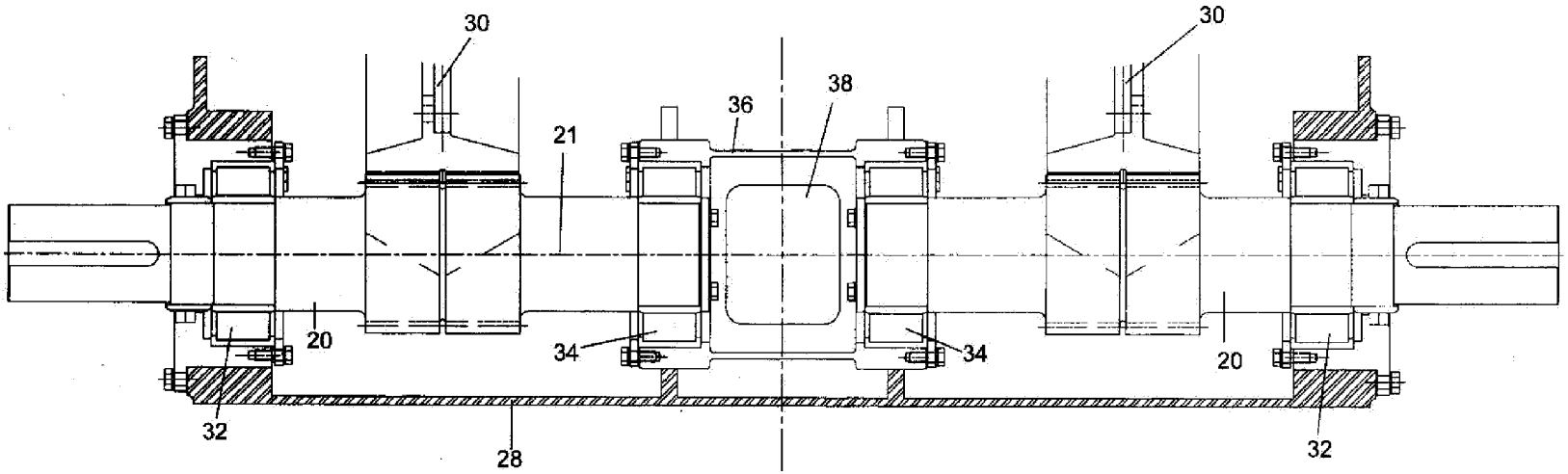
FIG. 3 is a detailed side view illustrating the pair of pinion shafts.

FIG. 3 illustrates two pinion shafts, which each have a central axis substantially coaxial with axis 21. Each pinion shaft rotates a respective bull gear 30, which in turn drives the crankshaft. Bearings 32 each outward of a respective bull gear are provided to control rotation of each pinion shaft, and cooperate with internal bearings 34 which are inward of the bull gears and are supported on brackets 36, with the external bearing race being fixed to the housing 28. Aperture 38 may be provided within the bracket 36 for facilitating assembly. Arm 39 as shown in FIG. 4 allows a pipe or other tool to apply manual torque to the bracket during assembly.

The interface between each pinion shaft 20 and the respective bull gear 30 may be made with helical gearing to avoid axial thrust loading. More specifically, the pinion gear and the mating bull gear may each use a herringbone tooth profile 60, as conceptually shown in FIG. 4. As used herein, the term "herringbone tooth profile" includes a "double helix groove profile," although these latter grooves typically have a deeper groove profile than most herringbone tooth profiles. The two bull gears preferably have opposite hand gearing, which allows the pump to be conventionally driven by standard motors. The gearing thus uses a pinion gear on each pinion shaft that is coupled to a bull gear on a crankshaft to transfer rotation from the pinion shaft to the crankshaft, then from the crankshaft to the pistons.

Figure 4:
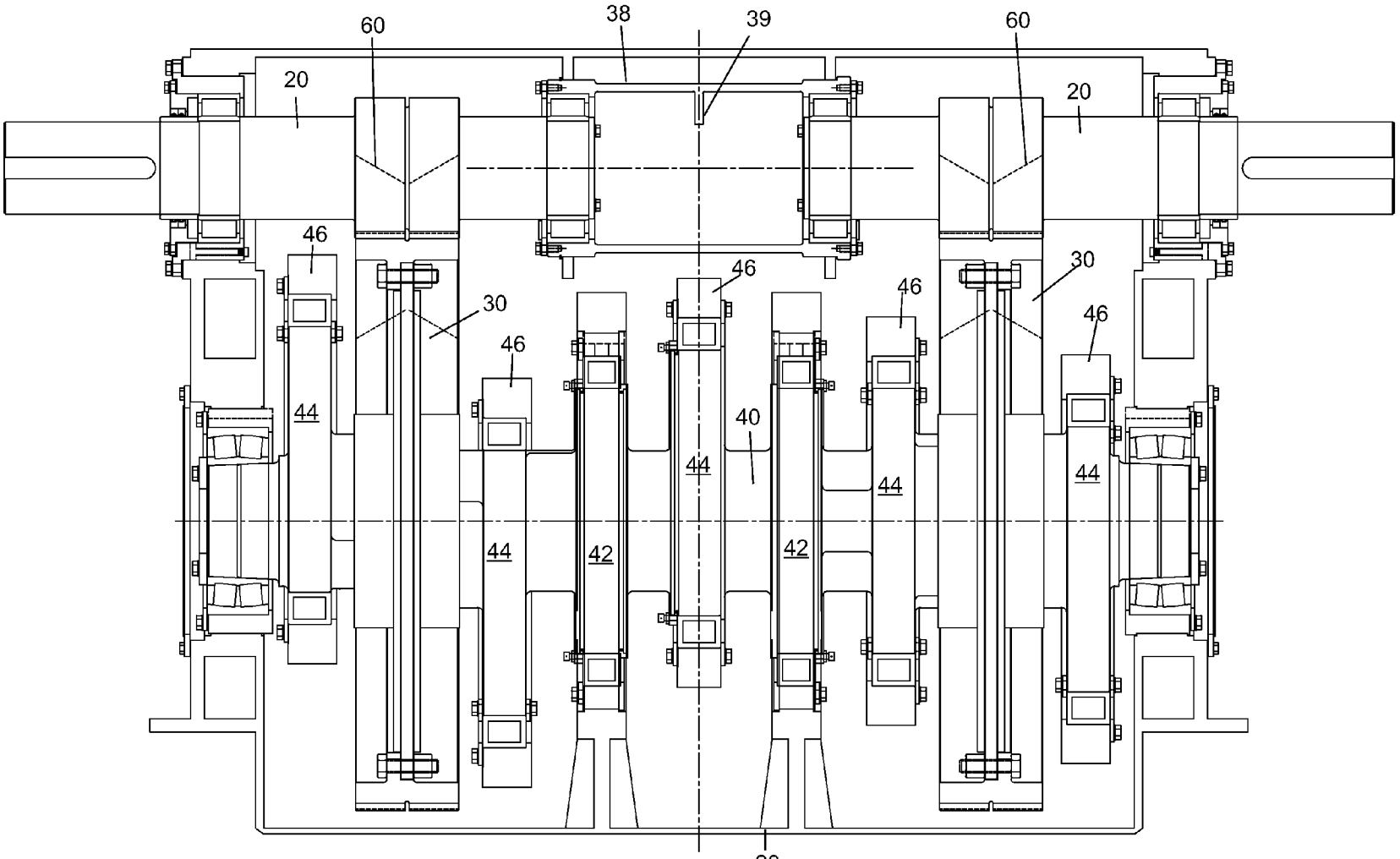
FIG. 4 is a cross-sectional view of the power assembly of the pump showing the pinion shafts, the bull gears, and the crankshaft.

Referring now to FIG. 4, the two pinions shafts 20 each rotate a respective bull gear 30, which in turn rotate crankshaft 43. The bearing lobes 42 provide rotational support for the rotating crankshaft, and are spaced interior of the bull gears 30. Eccentric lobes 44 are spaced substantially equidistant along the crankshaft, with two lobes being exterior of the bull gears 30, and each of the three interior lobes being spaced between a bull gear and a bearing lobe 42, or between the two interior bearing lobes 42. Connecting rods 46 are shown in FIG. 4 for interconnecting an eccentric lobe 44 and a respective piston.

Each of the bearings 32, 34 which guide rotation of the structurally separate pinion shafts are floating bearings, meaning that the bearings allow some limited movement of the pinion axis so that the gear on each pinion shaft will become aligned with the mating gear on the bull gear. The combination of the floating bearings 32, 34 on each pinion shaft and the meshing of a pinion gear with a mating bull gear each having a herringbone tooth profile thus contributes to the high reliability and long life of the assembly.

Each connecting rod 46 connects a respective eccentric lobe to a piston, and is guided by roller bearings. During rotation of the crankshaft 40, the connecting rods 46 transfer the crankshaft rotational movement to a reciprocating motion of the pistons or plungers in the pump's fluid assembly. By using roller bearings to rotationally support the crankshaft to transfer motion to the connecting rods, the quintuplex mud pump can significantly reduce the white noise typically produced by conventional triplex pumps. One end of the crankshaft may optionally extend outside the power assembly for coupling to a gear reducer or other external components.

As shown in FIG. 4, rotation of the crankshaft reciprocates five independent connecting rods 46. Each connecting rod couples to a crosshead 52 of the crosshead assembly 14, and the crossheads convert the connecting rods movement into a reciprocating movement of an intermediate pony rod 54 (see FIG. 1). The crossheads 52 convert the movement of a connecting rod into a reciprocating movement of an intermediate pony rod 54, which in turn drives the coupled piston or plunger of the fluid assembly 16. Crank pins may be used to convert the rotation of the crankshaft into a reciprocating motion for operating the pistons in the fluid assembly of the pump. Connecting rods 46 connect to the pistons or plungers by the crosshead assembly. The five connecting rods may also use roller bearings to interface with the eccentric lobes. A pony rod 54 drives a coupled piston or plunger in the fluid assembly that pumps mud from the intake manifold to the output manifold. The mud pump has five such pistons which are stroked in a timed manner for pumping mud. Each of the eccentric lobes 44 thus actuates the respective piston in a preselected firing order.

By providing two structurally independent pinion shafts, each shaft supported on a pair of floating bearings and driving a respective bull gear with herringbone gearing between each pinion shaft and bull gear, timing issues inherent in one pinion shaft driving two bull gears are avoided. Each side of the herringbone gearing, being opposite the other with respect to a gear centerline and inclined in an opposing manner, cancels out the other side of the same herringbone gearing, thereby avoiding significant timing problems of the prior art. During operation, one motor may transmit slightly more torque to the crankshaft than the other motor, but that is not a concern since the construction of the quintuplex mud pump avoids timing issues involving a single pinion shaft and two bull gears.

The axis of each pinion shaft is thus substantially aligned with the axis of the other pinion shaft, and each of these axes is substantially parallel to the axis of the crankshaft. Since the diameter of the bull gears is preferably the same, the first and second pinion shafts may be substantially coaxial.

As disclosed herein, a pair of motors powers a pair of pinion shafts. In other embodiments, a plurality of motors may be used to power a plurality of pinion shafts, e.g., four separate motors powering four separate pinion shafts, with the two additional pinion shafts being positioned above the two shown in the drawings, and two additional bull gears added to drive the common crankshaft.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A quintuplex pump, comprising:

a pump housing;

a first pinion shaft, having a first pinion gear thereon, rotatably supported within a pump housing and connectable to a first motor;

a second pinion shaft, having a second pinion gear thereon, rotatably supported within a pump housing and connectable to a second motor that is separate from the first motor; and a single crankshaft rotatably supported in the pump housing by a plurality of bearings, the crankshaft having five eccentric lobes, a first bull gear, aligned to engage first pinion gear on the first pinion shaft, and a second bull gear, aligned to engage the second pinion gear on the second pinion shaft;

wherein the five eccentric lobes on the single crankshaft are each connectable to one of five connecting rods, each of the connecting rods connected at a first end to one of the five eccentric lobes on the single crankshaft and coupled at a second end to one of five pistons disposed within cylinders of the pump to thereby convert rotation of the single crankshaft and of the eccentric lobe connected to the first end of each connecting rod to linear reciprocation of a connected piston coupled to the second end of the connecting rod; and wherein the first pinion shaft and second pinion shaft are indirectly rotationally coupled one to the other through the first bull gear, the single crankshaft and the second bull gear.

2. The pump of claim 1, wherein each of the first pinion shaft and the second pinion shaft is rotatably supported on a first outer floating bearing and a second inner floating bearing, each of the first outer floating bearing and the second inner floating bearing being axially adjustable to enable axial adjustment of the position of the first pinion gear on the first pinion shaft with respect to the first bull gear engaged and driven thereby, and to enable axial adjustment of the position of the second pinion gear on the second pinion shaft with respect to the second bull gear engaged and driven thereby.

3. The pump of claim 2, wherein the second inner floating bearing supporting the first pinion shaft and the second inner floating bearing supporting the second pinion shaft are together supported on a common bracket secured to the pump housing; and wherein the first pinion shaft and the second pinion shaft are axially aligned one with the other.

4. The pump of claim 1, wherein each of the first pinion near on the first pinion shaft, the second pinion gear on the second pinion shaft, the first bull gear on the single crankshaft and the second bull gear on the single crankshaft comprise herringbone gear teeth.

5. The pump of claim 1, wherein an axis of the first pinion shaft is substantially aligned with an axis of the second pinion shaft and both of the axes of the first pinion shaft and the second pinion shaft are parallel to an axis of the single crankshaft driven thereby.

6. The pump of claim 1, wherein each of the five connecting rods that are connected at a first end to an eccentric lobe on the single crankshaft couples at the second end to a crosshead, and wherein the crosshead couples to a piston.

7. The pump of claim 1, wherein the first pinion Shaft and the second pinion shaft are aligned one with the other.

8. A quintuplex pump, comprising;

a pump housing;

a first pinion shaft, having a first pinion gear thereon, mutably supported on a first set of floating bearings within the pump housing, the first pinion shaft being connectable to a first motor;

a second pinion shaft, having a second pinion gear thereon, rotatably supported on a second set of floating bearings within the pump housing, the second pinion shaft being connectable to a second motor; and a single crankshaft rotatably supported in the pump housing by a plurality of bearings and having five eccentric lobes, first bull gear, to be engaged and driven by the first pinion gear, and a second bull gear, to be engaged and driven by the second pinion gear;

wherein the eccentric lobes on the single crankshaft are each connectable to one of five connecting rods, each of the five connecting rods connected at a first end to one of the five eccentric lobes on the single crankshaft and at a second end to one of five pistons, each piston movable within one of five cylinders, to convert rotation of the eccentric lobe connected to the first end of a connecting rod to linear reciprocation of a piston connected to a second end of the connecting rod;

wherein the first pinion gear engages the first bull gear through a set of herringbone gear teeth; and wherein the second pinion gear engages the second bull gear through a set of herringbone gear teeth.

9. The pump of claim 8, wherein an axis of the first pinion shaft is substantially aligned with an axis of the second pinion shaft and both of the axes of the first pinion shaft and the second pinion shaft are parallel to an axis of the single crankshaft.

10. The pump of claim 8, wherein the first pinion shaft is rotatably supported on a first floating bearing and a second floating bearing to provide for adjustment of the position of the first pinion gear to align with the first bull gear engaged and driven thereby; and wherein the second pinion shaft is rotatably supported on a first floating bearing and a second floating bearing to provide for adjustment of the position of the second pinion gear to align with the second bull gear engaged and driven thereby.

11. The pump of claim 10, wherein the second floating bearing supporting the first pinion shaft and the second floating bearing supporting the second pinion shaft are together supported on a common bracket secured to the pump housing.

12. The pump of claim 8, wherein each of the five connecting rods couples at the second end to a crosshead, and wherein the crosshead couples to a piston within a cylinder.

13. A quintuplex pump, comprising:

a first pinion shaft, having a first pinion gear thereon, and a second pinion shaft having a second pinion gear thereon, each of the first and second pinion shafts rotatably supported within a pump housing by a plurality of floating bearings; and a single crankshaft rotatably supported within the pump housing by a plurality of bearings, the single crankshaft having five eccentric lobes thereon, first bull gear, engaged to be driven by rotation of the first pinion shaft and the first pinion gear thereon, and a second bull gear engaged to be driven by rotation of the second pinion shaft and the second pinion gear thereon; and wherein each of the five eccentric lobes on the single crankshaft is connected to a first end of one of five connecting rods, each of the connecting-rods connected at a first end to one of the five eccentric lobes on the single crankshaft and at a second end to one of five pistons movable within one of five cylinders to convert rotation of the eccentric lobe connected to the first end of the connecting rod to reciprocation of the piston connected to the second end of the connecting rod.

14. The pump of claim 13, wherein an axis of rotation of the first pinion shaft is aligned with an axis of rotation of the second pinion shaft; and the axes of both the first pinion shaft and the second pinion shaft are parallel to an axis of rotation of the crankshaft.

15. The pump of claim 13, wherein each of the five connecting rods couples at the second end to a crosshead, and wherein the crosshead couples to a piston movable within a cylinder.

16. The pump of claim 13, wherein the first pinion gear engages and drives the first bull gear, and the second pinion gear engages and drives the second bull gear, through herringbone gear teeth.

17. The pump of claim 13, wherein at least one of the plurality of floating bearings supporting the first pinion shaft and at least one of the plurality of floating bearings supporting the second pinion shaft are together supported on a common bracket secured to the pump housing.

* * * * *